US011138964B2

(12) United States Patent
Ping et al.

(10) Patent No.: US 11,138,964 B2
(45) Date of Patent: Oct. 5, 2021

(54) INAUDIBLE WATERMARK ENABLED TEXT-TO-SPEECH FRAMEWORK

(71) Applicant: Baidu USA LLC, Sunnyvale, CA (US)

(72) Inventors: Wei Ping, Sunnyvale, CA (US); Zhenyu Zhong, Sunnyvale, CA (US); Yueqiang Cheng, Sunnyvale, CA (US); Xing Li, Sunnyvale, CA (US); Tao Wei, Sunnyvale, CA (US)

(73) Assignee: BAIDU USA LLC, Sunnyvale, CA (US)

( * ) Notice: Subject to any disclaimer, the term of this patent is extended or adjusted under 35 U.S.C. 154(b) by 0 days.

(21) Appl. No.: 16/659,550

(22) Filed: Oct. 21, 2019

(65) Prior Publication Data

US 2021/0118423 A1 Apr. 22, 2021

(51) Int. Cl.
*G10L 13/047* (2013.01)
*G10L 25/30* (2013.01)
*G10L 19/018* (2013.01)

(52) U.S. Cl.
CPC ..... *G10L 13/047* (2013.01); *G10L 19/018* (2013.01); *G10L 25/30* (2013.01)

(58) Field of Classification Search
CPC ..... G10L 19/018; G10L 25/30
USPC ..... 704/257–275
See application file for complete search history.

(56) References Cited

U.S. PATENT DOCUMENTS

| | | | | |
|---|---|---|---|---|
| 7,095,872 | B2 * | 8/2006 | Najarian | G06T 1/0028 375/E7.018 |
| 7,526,430 | B2 * | 4/2009 | Kato | G10L 13/10 381/13 |
| 8,589,167 | B2 * | 11/2013 | Baughman | G10L 17/26 704/270 |
| 9,818,414 | B2 * | 11/2017 | Phielipp | G10L 15/22 |
| 9,881,623 | B2 * | 1/2018 | Nakamura | G10L 13/06 |
| 2019/0287513 | A1 * | 9/2019 | Alameh | G10L 19/018 |
| 2019/0362719 | A1 * | 11/2019 | Gruenstein | G10L 17/00 |
| 2020/0098379 | A1 * | 3/2020 | Tai | G10L 15/22 |

* cited by examiner

*Primary Examiner* — Jesse S Pullias
(74) *Attorney, Agent, or Firm* — Womble Bond Dickinson (US) LLP

(57) ABSTRACT

According to various embodiments, an end-to-end TTS framework can integrate a watermarking process into the training of the TTS framework, which enables watermarks to be imperceptible within a synthesized/cloned audio segment generated by the TTS framework. The watermarks added in such a matter are statistically undetectable to prevent authorized removal. According to an exemplary method of training the TTS framework, a TTS neural network model and a watermarking neural network mode in the TTS framework are trained in an end to end manner, with the watermarking being part of the optimization process of the TTS framework. During the training, neuron values of the TTS neural network model are adjusted based on training data to prepare one or more spaces for adding a watermark in a synthesized audio segment to be generated by the TTS framework.

20 Claims, 8 Drawing Sheets

INAUDIBLE WATERMARK ENABLED TEXT-TO-SPEECH FRAMEWORK

TECHNICAL FIELD

Embodiments of the present disclosure relate generally to neural network based speech synthesizing. More particularly, embodiments of the disclosure relate to a text to speech (TTS) framework for adding inaudible watermarks.

BACKGROUND

Neural network based speech synthesis (a.k.a. text-to-speech) has obtained human-like high-fidelity speech, and has successfully produced different voices in a single text-to-speech (TTS) model. Due to the lack of differentiation between a synthesized voice produced by such models and a real human voice, the models may be used for malicious purpose, for example, synthesizing hate speech.

Some companies have used watermarking technology to verify whether a synthesized audio is generated by a particular TTS model to prevent malicious voice cloning, and to enforce their copyright. However, under the existing solutions, watermarks are typically added as part of the post processing of a synthesized audio sample, which can be easily bypassed or forged. Further, the watermarks typically represent additional signals/noises to the synthesized audio sample, which makes watermarks user-unfriendly.

BRIEF DESCRIPTION OF THE DRAWINGS

Embodiments of the disclosure are illustrated by way of example and not limitation in the figures of the accompanying drawings in which like references indicate similar elements.

DETAILED DESCRIPTION

Figure 1:
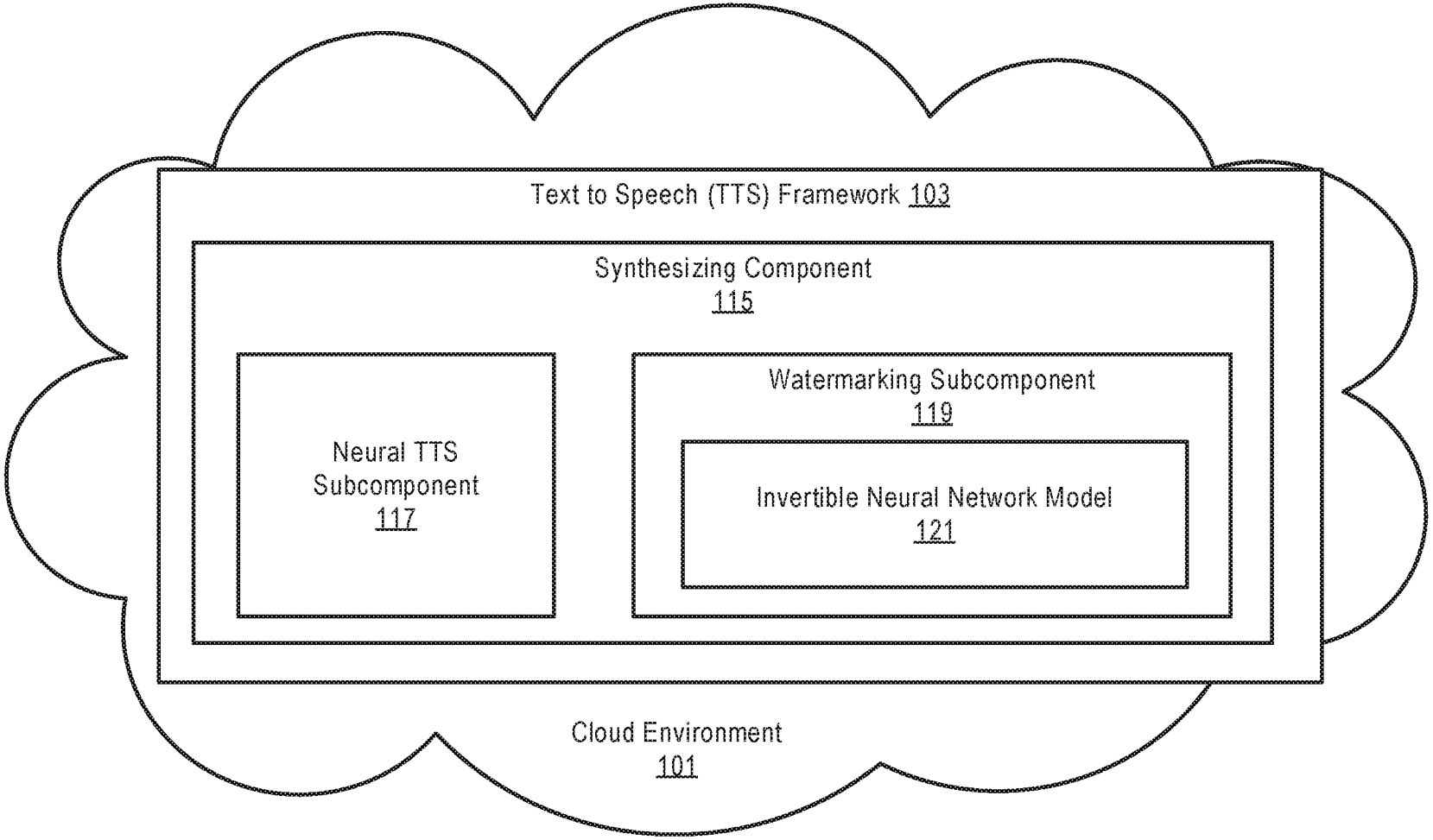
FIG. 1 illustrates an example text to speech (TTs) framework in accordance with an embodiment.

Various embodiments and aspects of the disclosures will be described with reference to details discussed below, and the accompanying drawings will illustrate the various embodiments. The following description and drawings are illustrative of the disclosure and are not to be construed as limiting the disclosure. Numerous specific details are described to provide a thorough understanding of various embodiments of the present disclosure. However, in certain instances, well-known or conventional details are not described in order to provide a concise discussion of embodiments of the present disclosures.

Reference in the specification to "one embodiment" or "an embodiment" means that a particular feature, structure, or characteristic described in conjunction with the embodiment can be included in at least one embodiment of the disclosure. The appearances of the phrase "in one embodiment" in various places in the specification do not necessarily all refer to the same embodiment.

According to various embodiments, an end-to-end TTS framework can integrate the watermarking process into the training of the TTS framework, which enables watermarks to be imperceptible within a synthesized/cloned audio segment generated by the TTS framework. The watermarks added in such a matter are statistically undetectable to prevent unauthorized removal.

According to an exemplary method of training the TTS framework, a TTS neural network model and a watermarking neural network model in the TTS framework are trained together in an end-to-end manner. During the training, neuron values of the TTS neural network model are adjusted based on a set of the training data, to prepare one or more spaces in a synthesized audio segment to be generated by the TTS framework for adding a watermark. In response to the neuron value adjustment in the TTS neural network model, neuron values of the watermarking neural network model are accordingly adjusted to add the watermark to the one or more prepared spaces.

In one embodiment, the watermarking neural network model is an invertible neural network that provides a one-to-one mapping between an input audio segment and a watermarked audio segment. In one embodiment, the neuron values in each of the TTS neural network model and the watermarking neural network model include weights, biases and activation functions. The neuron values of the TTS neural network are adjusted during the training of the TTS framework such that the watermark added to the one or more spaces are inaudible in the synthesized audio segment generated by the TTS framework. Adding the watermark is performed by multiple layers of neurons associated with weights, biases and activation functions in the watermarking neural network model.

In one embodiment, the TTS framework can generate a synthesized audio segment that includes one or more speech phrases overlapped with a speech phrase representing the watermark, such that the one or more speech phrases cover the watermark speech phrase. One or more physical properties associated with the speech phrases can be modified during the training of the TTS framework to cover the watermark speech phrase.

According to another embodiment, a method of verifying a watermarked audio segment can include the operations of receiving the watermarked audio segment and proprietary information; and obtaining, based on the proprietary information, an original audio segment from the watermarked audio segment using a neural network model, the neural network model being part of a synthesizing component used to generate the watermarked audio segment. The method further includes the operations of obtaining an actual watermark embedded in the watermarked audio segment based on a comparison between the watermarked audio segment and the original audio segment. By comparing the actual watermark and a predetermined watermark used for training the synthesizing component, the method can determine whether the watermarked audio segment is generated by the synthesizing component FIG. 1 illustrates an example text to speech (TTs) framework in accordance with an embodiment. As shown in FIG. 1, a TTS framework 103 can be provided in a cloud environment 101 to end users, which can access the speech synthesizing functionality via a set of an application programming interfaces (APIs).

A synthesizing component 115 in the cloud environment 101 can be called via the APIs to generate, from text, synthesized speeches with one or more predetermined a watermark embedded in the synthesizing component 115 during the training of the component. The synthesizing component 115 can include a neural TTS subcomponent 117 and a watermarking subcomponent 119, each of which can be a trained neural network model.

In one embodiment, the s neural TTS subcomponent 117 can be any end to end neural network model for speech synthesis, and the watermarking subcomponent 119 can be an invertible neural network that provides a one-to-one mapping between an input audio segment and a watermarked audio output.

The watermarking subcomponent 119 is trained to add watermarks to a synthesized audio segment. However, instead of adding the watermarks as part of the posting-processing of the synthesized audio segment, the watermarking subcomponent 119 adds the watermarks during the training of the synthesized component 115; namely, the watermarking is part of the optimization process during the training of the TTS framework 103.

With the features described above, the watermarking process can be integrated into the speech synthesizing process, which enables the watermarks to be imperceptible within the synthesize/cloned audio segments. The watermarks added in such a matter are statistically undetectable to prevent authorized removal, and are robust to audio manipulation and single processing operations, e.g., noise, compression, playing over-the-air etc. As an illustrative example, the watermarks in such a synthesized audio segment cannot be removed by playing the audio segment over the air and recording it—the recorded audio segment would still have the watermarks.

Further, the use of the invertible neural network model 121 can make it easy to extract the watermarks for verifying whether a watermarked audio segment is generated by the TTS framework 103, so that the copyright owner can be verified.

Figure 2:
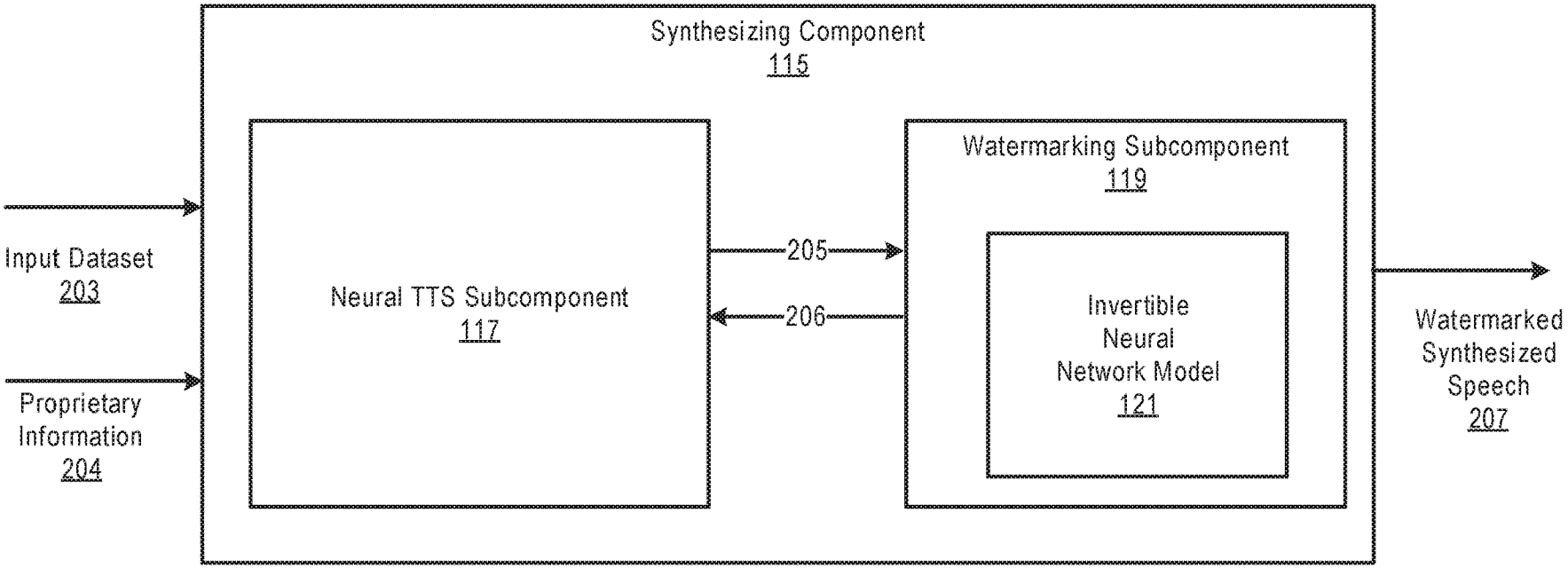
FIG. 2 illustrates an example system for training a TTS synthesizing component in accordance with an embodiment.

FIG. 2 illustrates an example system for training a TTS synthesizing component in accordance with an embodiment. As described in FIG. 1, each of the neural TTS subcomponent 117 and the watermarking subcomponent 119 can be a neural network model. A neural network model typically includes a collection of connected neurons. The neurons can be fully connected, with each neuron in one layer connecting with parameters (e.g., weights and biases) to every neuron in the following layer.

During the training of a neural network model, gradient descent (i.e. backpropagation) can be used to determine a set of parameters that minimize the difference between expected values and actual output of the neural network model. The gradient descent includes the steps of calculating gradients of the loss/error function, and updating existing parameters in response to the gradients. The cycle can be repeated until the minima of the loss function are reached.

Referring back to FIG. 2, the whole synthesizing component 115 is trained end to end as a single unit, instead of each of the neural TTS subcomponent 117 and the watermarking subcomponent in the synthesizing component 115 being trained independently.

As shown in FIG. 2, during the training of the synthesizing component 115, there can be constant interactions between the two subcomponents: the neural TTS subcomponent 117 and the watermarking subcomponent 119. Each subcomponent can have its own loss function. The neural TTS subcomponent 115 can have losses from a decoder and a vocoder for synthesizing high-fidelity voices. The watermark component 119, as an invertible neural network, can have the perceptual loss for penalizing the deviation from the synthesized high-fidelity voices.

In one embodiment, the interactions between the two subcomponents 117 and 119 can represent collaboration between the two subcomponents during the training, with errors in one subcomponent being corrected by the other subcomponent.

During the training of the synthesizing component, input dataset 203 and proprietary information 204 are provided to the synthesizing component 115 as input. The input dataset 203 can include multiple samples, each sample representing a text/audio pair. The proprietary information 204 can include any information related to a watermark to be added to a synthesized audio segment to be generated by the synthesizing component 115 after it has been trained.

Each input sample can be provided as input for the neural TTS subcomponent 117, which includes initial neuron values in its layers. Examples of the neural values can include weight values, biases, and associated activation functions. When each input sample passing through the synthesizing component 117, the initial neuron values can be updated accordingly.

In one embodiment, the output of the neural TTS subcomponent 117 can be a set of neuron outputs 205, which can be fed into the watermarking subcomponent 119. In response to the updated neuro values received from the neural TTS subcomponent 117, neuron values in each layer of the watermarking subcomponent 119 can be updated as well.

Based on the loss function calculation results from a batch of the input data, gradient values 206 are backward propagated through a starting layer of the synthesizing component 115. Weights from each layer of the synthesizing component 115 are updated accordingly based on the gradient value calculated for each layer. The above process can be repeated until the loss for the whole synthesizing component 115 converges.

From the neural network architecture perspective, the watermarking is represented by a number of layers of neurons associated with weights parameters and activation functions. Such representations can be obtained by various transformations. Different transformations can be attributed with different levels of security. Examples of the different transformations can include a plain text token with weak protection; a hashed token also with weak protection; a symmetric or an asymmetric encrypted token, which is a more secure way to protect the watermark from forgery; and a signed token, which is an even more secure way to protect the watermark from forgery than the symmetric or the asymmetric encrypted token.

With the synthesizing component 115 trained, an input text can pass through the trained model in a forward pass. The trained model 115 can generate an audio segment containing a watermark embedded during the training stage of the synthesizing component 115. The watermark is inaudible, imperceptible, and cannot be removed without using a verification component that implements the same invertible neural network model 121 in the watermarking subcomponent 119.

Figure 3:
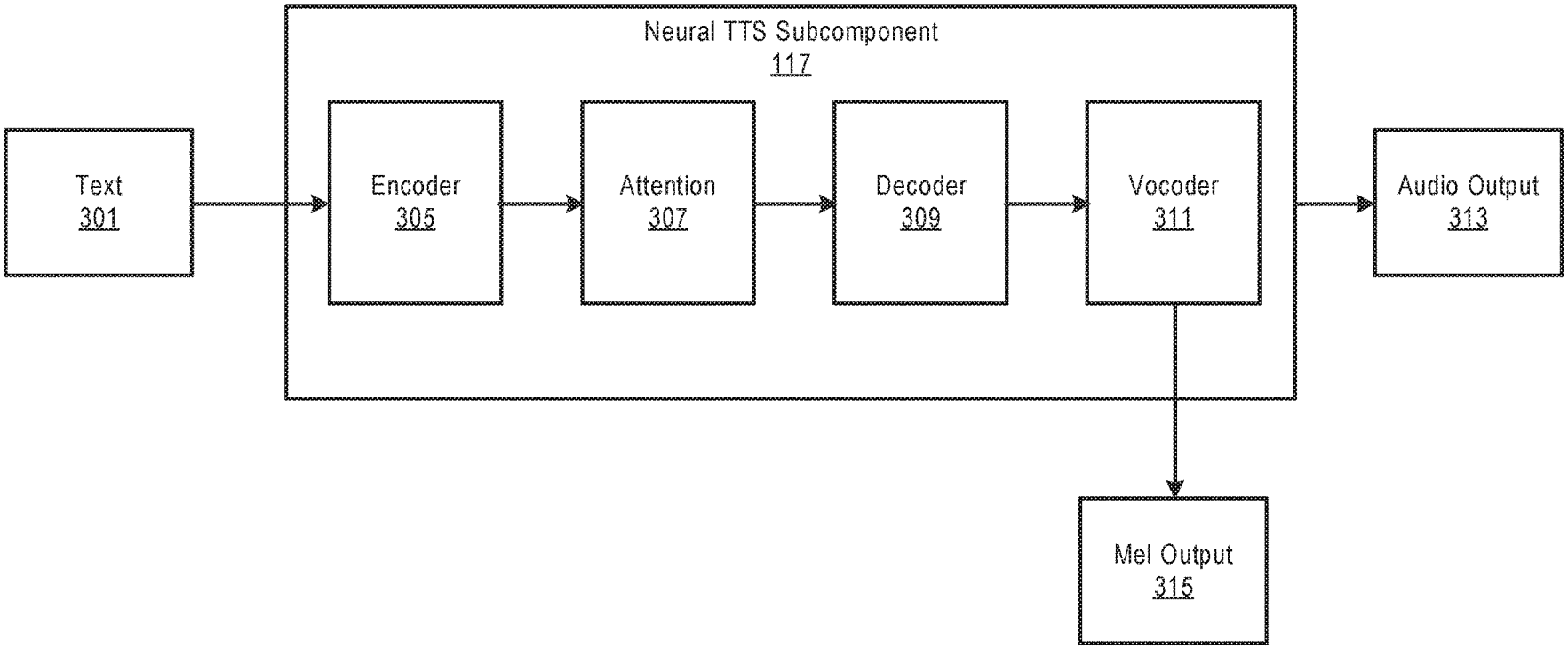
FIG. 3 illustrates an example neural TTS subcomponent in accordance with an embodiment.

FIG. 3 illustrates an example neural TTS subcomponent in accordance with an embodiment. In one embodiment, the example neural TTS subcomponent 117 can include a number of networks, such as an encoder network 305, a decoder network 309, an attention network 307 and a vocoder network 311. The neural TTS subcomponent 117 can learn the alignment between input text 301 and its intermediate representation (e.g., mel-spectrogram) 315 through the attention network 307.

The encoder network 305 encodes the character embeddings into a hidden feature representation. The attention network 307 can consume the output of the encoder network 305 to produces a fixed-length context vector for each decoder output. The decoder network 309 can be an autoregressive recurrent neural network and can consume the output from the attention network 307 and predict the sequence of the spectrogram from the hidden feature representation. The vocoder 311 is used to analyze and synthesize the human voice signal from the spectrogram, and can be a deep neural network of time-domain waveforms.

As an illustration of the synthesizing process, the input text 301 can be converted by the example neural TTS subcomponent 117 into character embeddings, which are numeric representations of words. Character embeddings can next be fed into the encoder-attention-decoder architecture, which can constitute a recurrent sequence-to-sequence feature prediction network. The encoder-attention-decoder architecture can predict a sequence of a spectrogram, and convert or map character embeddings to a spectrogram. The spectrogram is then fed into the vocoder 311, which creates time-domain waveforms (i.e. speech) as an output audio segment 313.

Figure 4:
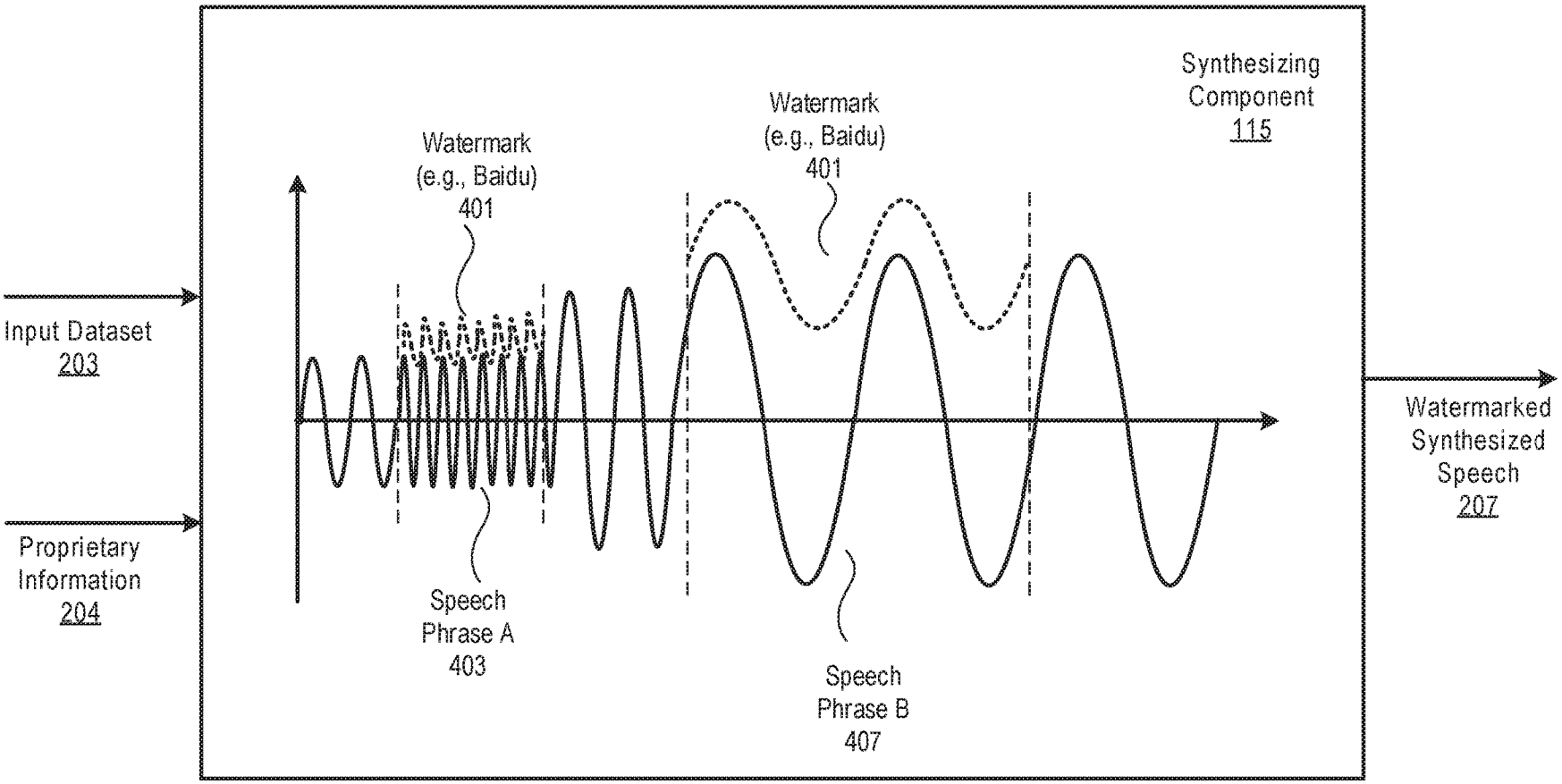
FIG. 4 illustrates example spaces in a synthesized audio segment generated by the synthesizing component in accordance with an embodiment.

FIG. 4 illustrates example spaces in a synthesized audio segment generated by the synthesizing component in accordance with an embodiment. As shown in FIG. 4, once the synthesizing component 115 is trained, it can generate a synthesized audio segment with a predetermined mark, which has been embedded into the trained synthesizing component during the training stage. The watermark is inaudible and imperceptible, and cannot be removed without authorization.

In one embodiment, a watermark in a synthesized audio segment generated by the synthesizing component 115 is inaudible because it is added to spaces where the watermark is covered by a speech phrase. The spaces are identified and prepared during the training stages by intelligently adjusting appropriate neuron values of one or more layers of the neural TTS subcomponent 117 and adjusting appropriate neuron values of one or more layers of the water marking subcomponent 119.

As shown in FIG. 4, a watermark 401 can be added to a space occupied by speech phrase A 403, and to another space occupied speech phrase B 407. Each space is selected based on one or more physical properties of the spaces, for example, the frequency band, the loudness, or the pitch of those spaces, such that the watermark 401, when added to those spaces, will be inaudible to a normal human ear.

In one embodiment, a speech phrase (e.g., speech phrase B 407) can be intentionally read at a slower pace in the audio segment so that the speech phrase can overlap with the watermark, such that the louder speech phrase can cover the watermark 401.

Figure 5:
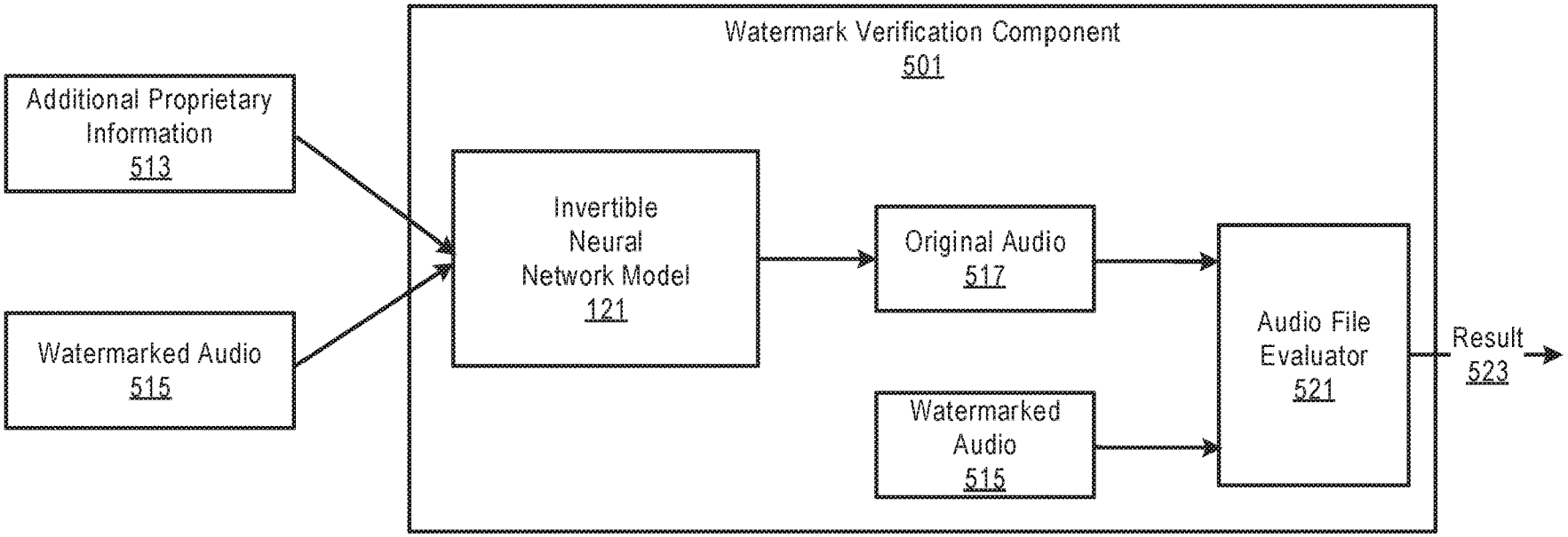
FIG. 5 illustrates a watermark verification component in accordance with an embodiment.

FIG. 5 illustrates a watermark verification component in accordance with an embodiment. As discussed above, the watermarking subcomponent 119 includes an invertible neural network model that guarantees a one-to-one mapping between an input audio segment and a watermarked audio segment. This feature can be used to verify whether a watermarked audio segment is generated from the synthesizing component 115.

In an example verification process shown in FIG. 5, input data includes a watermarked audio file 515 and additional proprietary information 513. The additional proprietary information 513 can be any information that a user of APIs exposed by the synthesizing component 115 uses to generate a watermark in the watermarked audio file 515. Such information generally is not disclosed to the public and will be used for watermark extraction. For example, such information can include some private key embedded into the water mark.

A watermark verification component 501 can include the same invertible neural network model 121 in the watermarking subcomponent 119. In response to receiving the watermarked audio 515, the watermark verification component 501 can run the invertible neural network to extract the watermark out of the watermarked audio 515 to obtain an original audio 517 that is without the watermark. The watermark extraction can be based on the additional proprietary information 513. The watermark extraction procedure corresponds to different levels of security defined in the watermarking subcomponent 119 in the synthesizing component 115.

The watermark verification component 501 can compute the difference between the original audio file 517 and the input watermarked audio 515 to obtain the actual watermark embedded in the watermarked audio 515 for verification. In one embodiment, the actual watermark and the watermark embedded into the synthesizing component 115 during the training stage can be compared to determine whether the watermarked audio 515 is generated by the trained synthesizing component 115.

Figure 6:
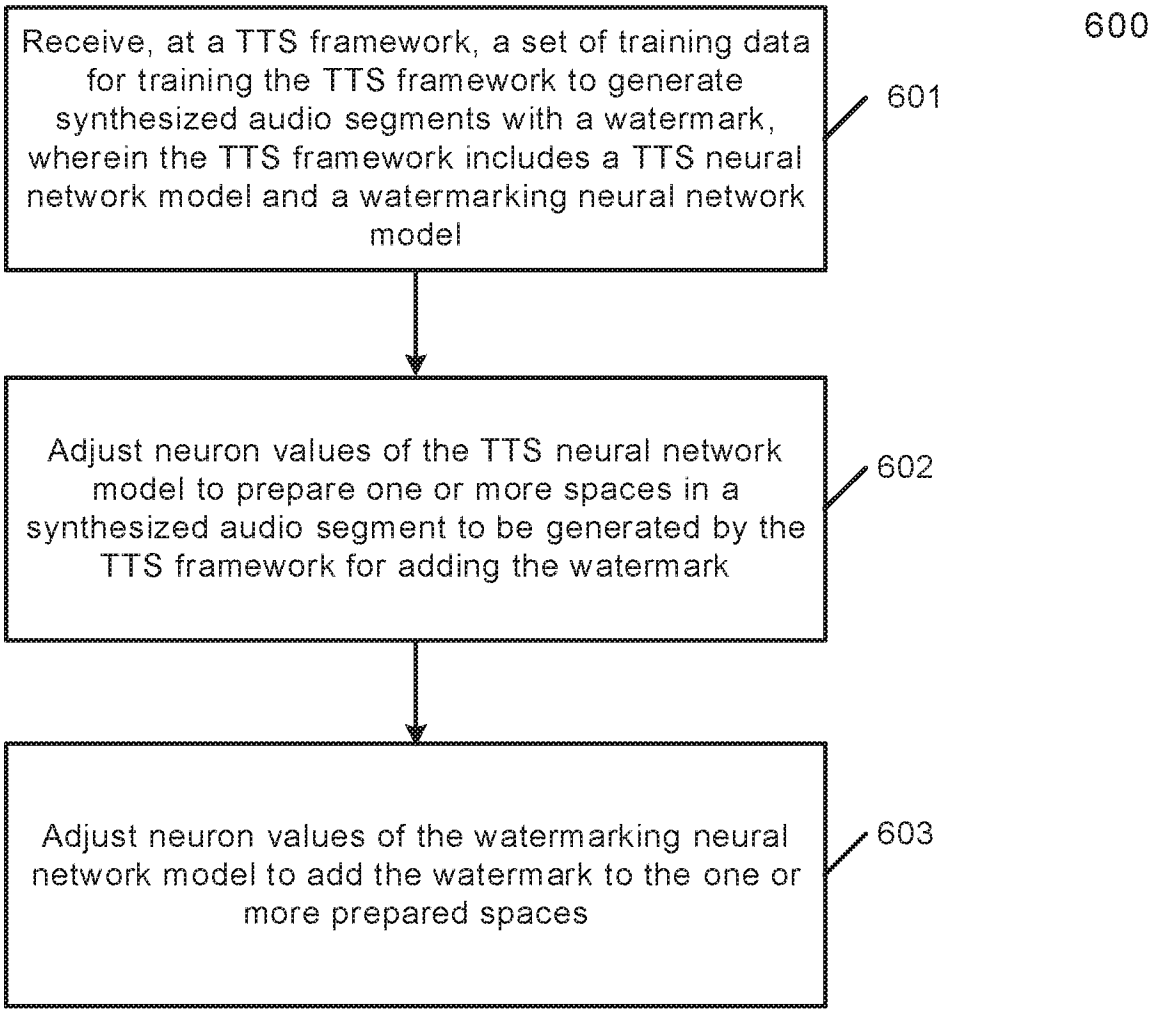
FIG. 6 illustrates an example process of training a TTS synthesizing component in accordance with an embodiment.

FIG. 6 illustrates an example process 600 of training a TTS synthesizing component in accordance with an embodiment. Process 600 may be performed by processing logic which may include software, hardware, or a combination thereof. For example, the process logic may include the synthesizing component 115 as descried in FIG. 1 and FIG. 2.

Referring back to FIG. 6, in operation 601, a TTS framework receives a set of training data for training the TTS framework to generate synthesized audio segments with a watermark, and the TTS framework includes a TTS neural network model and a watermarking neural network model. In operation 602, neuron values of the TTS neural network model can be adjusted to prepare one or more spaces in a synthesized audio segment to be generated by the TTS framework for adding the watermark. In operation 603, neuron values of the watermarking neural network model can be adjusted to add the watermark to the one or more prepared spaces.

Figure 7:
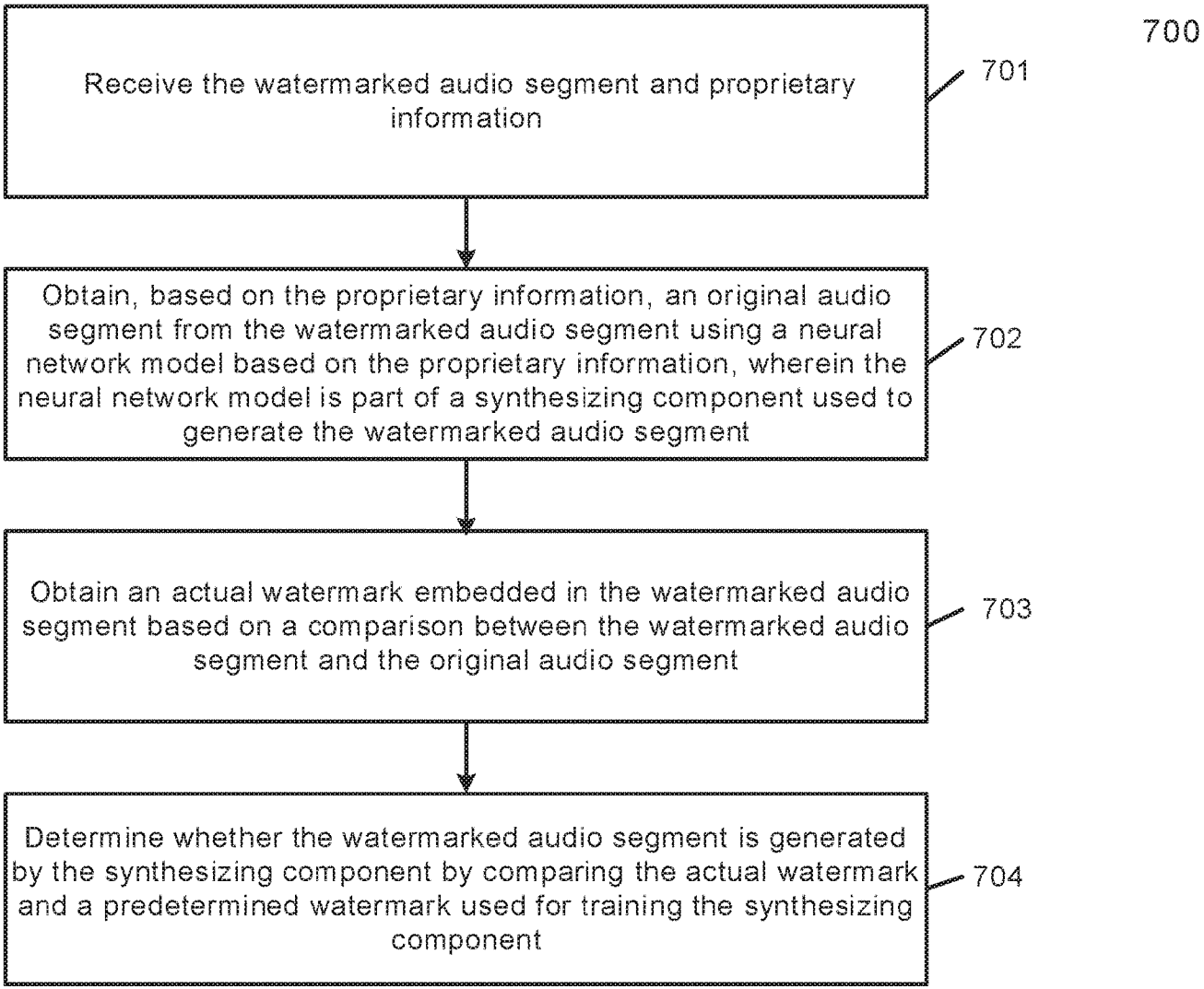
FIG. 7 illustrates an example process of verifying a synthesized audio segment in accordance with an embodiment.

FIG. 7 illustrates an example process 700 of verifying a synthesized audio segment in accordance with an embodiment. Process 700 may be performed by processing logic which may include software, hardware, or a combination thereof. For example, the process logic can be performed by the watermark verification component 501 described in FIG. 5.

Referring back to FIG. 7, in operation 701, a watermarked audio segment and proprietary information are received at the watermark verification component. In operation 702, the watermark verification component obtains, based on the proprietary information, an original audio segment from the watermarked audio segment using a neural network model based on the proprietary information, the neural network model being part of a synthesizing component used to generate the watermarked audio segment. In operation 703, the watermark verification component obtains an actual watermark embedded in the watermarked audio segment based on a comparison between the watermarked audio segment and the original audio segment. In operation 704, the watermark verification component determines whether the watermarked audio segment is generated by the synthesizing component by comparing the actual watermark and a predetermined watermark used for training the synthesizing component.

Figure 8:
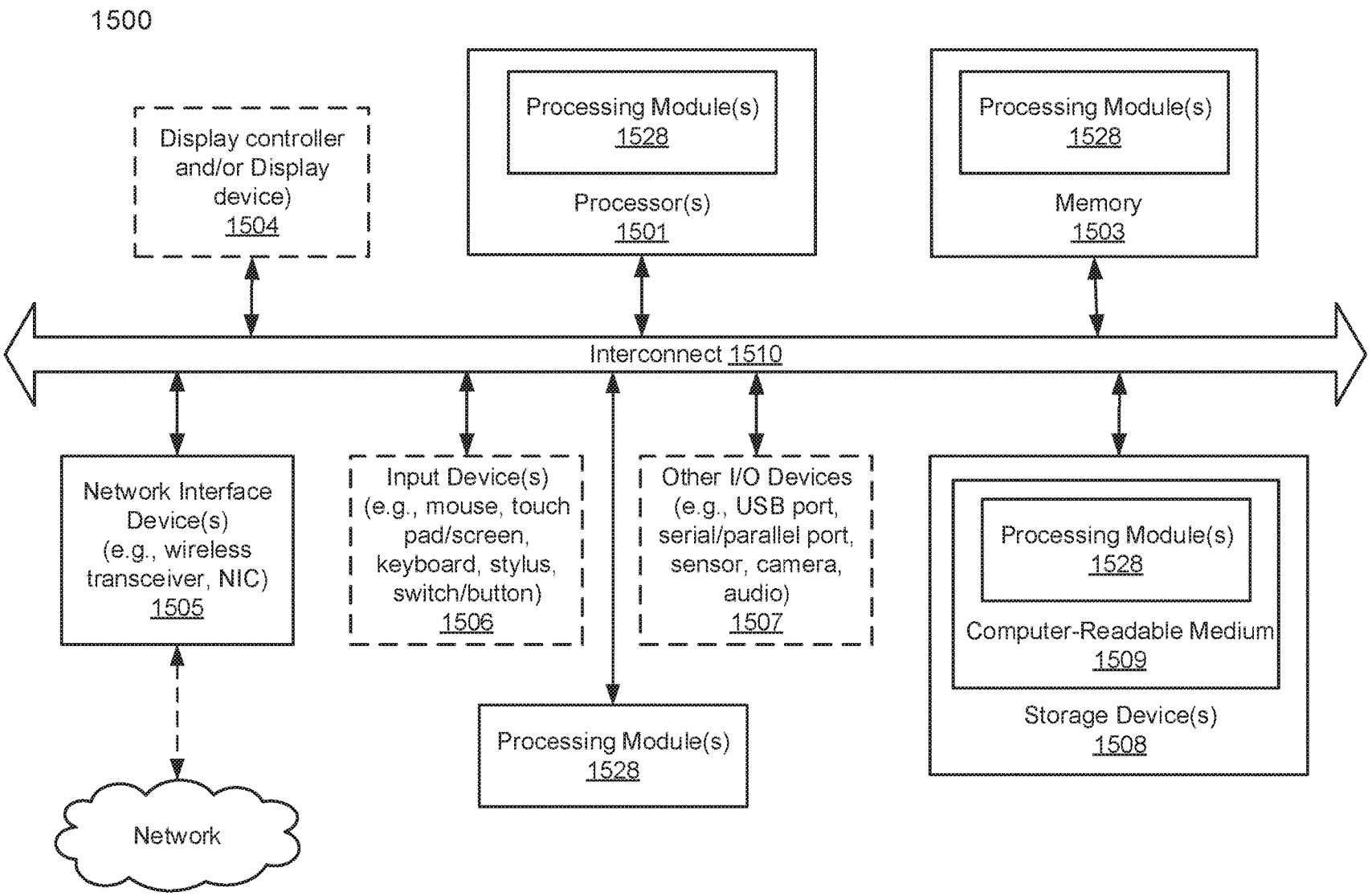
FIG. 8 illustrates an example of a data processing system according to one embodiment.

FIG. 8 is a block diagram illustrating an example of a data processing system which may be used with one embodiment of the invention. For example, system 1500 may represent any of data processing systems described above performing any of the processes or methods described above, such as, for example, a client device or a server described above, such as, for example, a cloud server or platform hosting a TTS framework, as described above.

Note also that system 1500 is intended to show a high level view of many components of the computer system. However, it is to be understood that additional components may be present in certain implementations and furthermore, different arrangement of the components shown may occur in other implementations. Further, while only a single machine or system is illustrated, the term "machine" or "system" shall also be taken to include any collection of machines or systems that individually or jointly execute a set (or multiple sets) of instructions to perform any one or more of the methodologies discussed herein.

In one embodiment, system 1500 includes processor 1501, memory 1503, and devices 1505-1508 via a bus or an interconnect 1510. Processor 1501 may represent a single processor or multiple processors with a single processor core or multiple processor cores included therein. Processor 1501 may represent one or more general-purpose processors such as a microprocessor, a central processing unit (CPU), or the like. More particularly, processor 1501 may be a complex instruction set computing (CISC) microprocessor, reduced instruction set computing (RISC) microprocessor, very long instruction word (VLIW) microprocessor, or processor implementing other instruction sets, or processors implementing a combination of instruction sets. Processor 1501 may also be one or more special-purpose processors such as an application specific integrated circuit (ASIC), a cellular or baseband processor, a field programmable gate array (FPGA), a digital signal processor (DSP), a network processor, a graphics processor, a network processor, a communications processor, a cryptographic processor, a co-processor, an embedded processor, or any other type of logic capable of processing instructions.

Processor 1501, which may be a low power multi-core processor socket such as an ultra-low voltage processor, may act as a main processing unit and central hub for communication with the various components of the system. Such processor can be implemented as a system on chip (SoC). Processor 1501 is configured to execute instructions for performing the operations and steps discussed herein. System 1500 may further include a graphics interface that communicates with optional graphics subsystem 1504, which may include a display controller, a graphics processor, and/or a display device.

Processor 1501 may communicate with memory 1503, which in one embodiment can be implemented via multiple memory devices to provide for a given amount of system memory. Memory 1503 may include one or more volatile storage (or memory) devices such as random access memory (RAM), dynamic RAM (DRAM), synchronous DRAM (SDRAM), static RAM (SRAM), or other types of storage devices. Memory 1503 may store information including sequences of instructions that are executed by processor 1501, or any other device. For example, executable code and/or data of a variety of operating systems, device drivers, firmware (e.g., input output basic system or BIOS), and/or applications can be loaded in memory 1503 and executed by processor 1501.

System 1500 may further include IO devices such as devices 1505-1508, including network interface device(s) 1505, optional input device(s) 1506, and other optional IO device(s) 1507. Network interface device 1505 may include a wireless transceiver and/or a network interface card (NIC). The wireless transceiver may be a WiFi transceiver, an infrared transceiver, a Bluetooth transceiver, a WiMax transceiver, a wireless cellular telephony transceiver, a satellite transceiver (e.g., a global positioning system (GPS) transceiver), or other radio frequency (RF) transceivers, or a combination thereof. The NIC may be an Ethernet card.

Input device(s) 1506 may include a mouse, a touch pad, a touch sensitive screen (which may be integrated with display device 1504), a pointer device such as a stylus, and/or a keyboard (e.g., physical keyboard or a virtual keyboard displayed as part of a touch sensitive screen). For example, input device 1506 may include a touch screen controller coupled to a touch screen. The touch screen and touch screen controller can, for example, detect contact and movement or break thereof using any of a plurality of touch sensitivity technologies, including but not limited to capacitive, resistive, infrared, and surface acoustic wave technologies, as well as other proximity sensor arrays or other elements for determining one or more points of contact with the touch screen.

IO devices 1507 may include an audio device. An audio device may include a speaker and/or a microphone to facilitate voice-enabled functions, such as voice recognition, voice replication, digital recording, and/or telephony functions. Other IO devices 1507 may further include universal serial bus (USB) port(s), parallel port(s), serial port(s), a printer, a network interface, a bus bridge (e.g., a PCI-PCI bridge), sensor(s) (e.g., a motion sensor such as an accelerometer, gyroscope, a magnetometer, a light sensor, compass, a proximity sensor, etc.), or a combination thereof.

To provide for persistent storage of information such as data, applications, one or more operating systems and so forth, a mass storage (not shown) may also couple to processor 1501. In various embodiments, to enable a thinner and lighter system design as well as to improve system responsiveness, this mass storage may be implemented via a solid state device (SSD). However in other embodiments, the mass storage may primarily be implemented using a hard disk drive (HDD) with a smaller amount of SSD storage to act as a SSD cache to enable non-volatile storage of context state and other such information during power down events so that a fast power up can occur on re-initiation of system activities. Also a flash device may be coupled to processor 1501, e.g., via a serial peripheral interface (SPI). This flash device may provide for non-volatile storage of system software, including a basic input/output software (BIOS) as well as other firmware of the system.

Storage device 1508 may include computer-accessible storage medium 1509 (also known as a machine-readable storage medium or a computer-readable medium) on which is stored one or more sets of instructions or software (e.g., module, unit, and/or logic 1528) embodying any one or more of the methodologies or functions described herein. Processing module/unit/logic 1528 may represent any of the components described above, such as, for example, a watermarking component as described above. Processing module/ unit/logic 1528 may also reside, completely or at least partially, within memory 1503 and/or within processor 1501 during execution thereof by data processing system 1500, memory 1503 and processor 1501 also constituting machine-accessible storage media. Processing module/unit/logic 1528 may further be transmitted or received over a network via network interface device 1505.

Computer-readable storage medium 1509 may also be used to store the some software functionalities described above persistently. While computer-readable storage medium 1509 is shown in an exemplary embodiment to be a single medium, the term "computer-readable storage medium" should be taken to include a single medium or multiple media (e.g., a centralized or distributed database, and/or associated caches and servers) that store the one or more sets of instructions. The terms "computer-readable storage medium" shall also be taken to include any medium that is capable of storing or encoding a set of instructions for execution by the machine and that cause the machine to perform any one or more of the methodologies of the present invention. The term "computer-readable storage medium" shall accordingly be taken to include, but not be limited to, solid-state memories, and optical and magnetic media, or any other non-transitory machine-readable medium.

Processing module/unit/logic 1528, components and other features described herein can be implemented as discrete hardware components or integrated in the functionality of hardware components such as ASICS, FPGAs, DSPs or similar devices. In addition, processing module/unit/logic 1528 can be implemented as firmware or functional circuitry within hardware devices. Further, processing module/unit/logic 1528 can be implemented in any combination hardware devices and software components.

Note that some or all of the components as shown and described above may be implemented in software, hardware, or a combination thereof. For example, such components can be implemented as software installed and stored in a persistent storage device, which can be loaded and executed in a memory by a processor (not shown) to carry out the processes or operations described throughout this application. Alternatively, such components can be implemented as executable code programmed or embedded into dedicated hardware such as an integrated circuit (e.g., an application specific IC or ASIC), a digital signal processor (DSP), or a field programmable gate array (FPGA), which can be accessed via a corresponding driver and/or operating system from an application. Furthermore, such components can be implemented as specific hardware logic in a processor or processor core as part of an instruction set accessible by a software component via one or more specific instructions.

Some portions of the preceding detailed descriptions have been presented in terms of algorithms and symbolic representations of operations on data bits within a computer memory. These algorithmic descriptions and representations are the ways used by those skilled in the data processing arts to most effectively convey the substance of their work to others skilled in the art. An algorithm is here, and generally, conceived to be a self-consistent sequence of operations leading to a desired result. The operations are those requiring physical manipulations of physical quantities.

All of these and similar terms are to be associated with the appropriate physical quantities and are merely convenient labels applied to these quantities. Unless specifically stated otherwise as apparent from the above discussion, it is appreciated that throughout the description, discussions utilizing terms such as those set forth in the claims below, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Embodiments of the disclosure also relate to an apparatus for performing the operations herein. Such a computer program is stored in a non-transitory computer readable medium. A machine-readable medium includes any mechanism for storing information in a form readable by a machine (e.g., a computer). For example, a machine-readable (e.g., computer-readable) medium includes a machine (e.g., a computer) readable storage medium (e.g., read only memory ("ROM"), random access memory ("RAM"), magnetic disk storage media, optical storage media, flash memory devices).

The processes or methods depicted in the preceding figures may be performed by processing logic that comprises hardware (e.g. circuitry, dedicated logic, etc.), software (e.g., embodied on a non-transitory computer readable medium), or a combination of both. Although the processes or methods are described above in terms of some sequential operations, it should be appreciated that some of the operations described may be performed in a different order. Moreover, some operations may be performed in parallel rather than sequentially.

Embodiments of the present disclosure are not described with reference to any particular programming language. It will be appreciated that a variety of programming languages may be used to implement the teachings of embodiments of the disclosure as described herein.

In the foregoing specification, embodiments of the disclosure have been described with reference to specific exemplary embodiments thereof. It will be evident that various modifications may be made thereto without departing from the broader spirit and scope of the disclosure as set forth in the following claims. The specification and drawings are, accordingly, to be regarded in an illustrative sense rather than a restrictive sense.

What is claimed is:

1. A computer-implemented method of training a text to speech (TTS) framework, the method comprising:

receiving, at a TTS framework, a set of training data for training the TTS framework to generate synthesized audio segments with a watermark, wherein the TTS framework includes a TTS neural network model and a watermarking neural network model;

adjusting neuron values of the TTS neural network model to prepare one or more spaces in a synthesized audio segment to be generated by the TTS framework for adding the watermark; and adjusting neuron values of the watermarking neural network model to add the watermark to the one or more prepared spaces.

2. The method of claim 1, wherein the TTS framework is trained using the set of training data end to end, including training the TTS neural network model and the watermarking neural network model together.

3. The method of claim 1, wherein the watermarking neural network model is an invertible neural network that provides a one-to-one mapping between an input audio segment and a watermarked audio segment.

4. The method of claim 1, wherein the neuron values in each of the TTS neural network model and the watermarking neural network model include weights, biases and activation functions.

5. The method of claim 4, wherein the neuron values of the TTS neural network model are adjusted during the training of the TTS framework such that the watermark added to the one or more spaces is inaudible in the synthesized audio segment generated by the TTS framework.

6. The method of claim 5, wherein adding the watermark is performed by a plurality of layers of neurons associated with weights, biases and activation functions in the watermarking neural network model.

7. The method of claim 1, wherein the TTS framework is trained to generate the synthesized audio segment including one or more speech phrases that are overlapped with a speech phrase representing the watermark, such that the one or more speech phrases cover the watermark speech phrase.

8. The method of claim 7, wherein one or more physical properties associated with the one or more speech phrases are modified during the training of the TTS framework to cover the watermark speech phrase.

9. The method of claim 8, wherein modifying the physical properties of the one or more speech phrases includes modifying a length of each of the one or more speech phrases such that each speech phrase covers the watermark phrase.

10. A non-transitory machine-readable medium having instructions stored therein for training a text to speech (TTS) framework, which instructions, when executed by a processor, cause the processor to perform operations, the operations comprising:

receiving, at a TTS framework, a set of training data for training the TTS framework to generate synthesized audio segments with a watermark, wherein the TTS framework includes a TTS neural network model and a watermarking neural network model;

adjusting neuron values of the TTS neural network model to prepare one or more spaces in a synthesized audio segment to be generated by the TTS framework for adding the watermark; and adjusting neuron values of the watermarking neural network model to add the watermark to the one or more prepared spaces.

11. The non-transitory machine-readable medium of claim 10, wherein the TTS framework is trained using the set of training data end to end, including training the TTS neural network model and the watermarking neural network model together.

12. The non-transitory machine-readable medium of claim 10, wherein the watermarking neural network model is an invertible neural network that provides a one-to-one mapping between an input audio segment and a watermarked audio segment.

13. The non-transitory machine-readable medium of claim 10, wherein the neuron values in each of the TTS neural network model and the watermarking neural network model include weights, biases and activation functions.

14. The non-transitory machine-readable medium of claim 13, wherein the neuron values of the TTS neural network model are adjusted during the training of the TTS framework such that the watermark added to the one or more spaces is inaudible in the synthesized audio segment generated by the TTS framework.

15. The non-transitory machine-readable medium of claim 14, wherein adding the watermark is performed by a plurality of layers of neurons associated with weights, biases and activation functions in the watermarking neural network model.

16. The non-transitory machine-readable medium of claim 10, wherein the TTS framework is trained to generate the synthesized audio segment including one or more speech phrases that are overlapped with a speech phrase representing the watermark, such that the one or more speech phrases cover the watermark speech phrase.

17. The non-transitory machine-readable medium of claim 16, wherein one or more physical properties associated with the one or more speech phrases are modified during the training of the TTS framework to cover the watermark speech phrase.

18. The non-transitory machine-readable medium of claim 17, wherein modifying the physical properties of the one or more speech phrases includes modifying a length of each of the one or more speech phrases such that each speech phrase covers the watermark phrase.

19. A data processing system, comprising:

a processor; and a memory coupled to the processor to store instructions, which when executed by the processor, cause the processor to perform operations, the operations including receiving, at a TTS framework, a set of training data for training the TTS framework to generate synthesized audio segments with a watermark, wherein the TTS framework includes a TTS neural network model and a watermarking neural network model;

adjusting neuron values of the TTS neural network model to prepare one or more spaces in a synthesized audio segment to be generated by the TTS framework for adding the watermark; and adjusting neuron values of the watermarking neural network model to add the watermark to the one or more prepared spaces.

20. The system of claim 19, wherein the watermarking neural network model is an invertible neural network that provides a one-to-one mapping between an input audio segment and a watermarked audio segment.

* * * * *